US010603784B2

(12) United States Patent
Timm et al.

(10) Patent No.: US 10,603,784 B2
(45) Date of Patent: Mar. 31, 2020

(54) CASE FOR ACCOMMODATING TOOLS OR SMALL PARTS

(71) Applicant: Adolf Würth GmbH & Co, KG, Künzelsau (DE)

(72) Inventors: Felix Timm, Dornstadt (DE); Johannes Starke, Ellhofen (DE); Daniel Kraus, Niederstotzingen (DE); Simon Koch, Dörzbach (DE); Wolfgang Hohl, Künzelsau (DE)

(73) Assignee: Würth International AG., Chur (CH)

( * ) Notice: Subject to any disclaimer, the term of this patent is extended or adjusted under 35 U.S.C. 154(b) by 0 days.

(21) Appl. No.: 15/534,098

(22) PCT Filed: Dec. 7, 2015

(86) PCT No.: PCT/EP2015/078850
§ 371 (c)(1),
(2) Date: Jun. 8, 2017

(87) PCT Pub. No.: WO2016/091818
PCT Pub. Date: Jun. 16, 2016

(65) Prior Publication Data

US 2017/0361455 A1 Dec. 21, 2017

(30) Foreign Application Priority Data

Dec. 11, 2014 (DE) ..... 10 2014 225 512

(51) Int. Cl.
*B25H 3/02* (2006.01)
*B25H 3/00* (2006.01)

(52) U.S. Cl.
CPC ..... *B25H 3/025* (2013.01); *B25H 3/006* (2013.01); *B25H 3/021* (2013.01)

(58) Field of Classification Search
CPC ..... B25H 3/025; B25H 3/006; B25H 3/021
USPC ..... 206/373, 372, 349, 214, 215; 220/521, 220/522
See application file for complete search history.

(56) References Cited

U.S. PATENT DOCUMENTS 1,953,887 A * 4/1934 Medoff ..... B65D 83/08 206/37
3,369,730 A * 2/1968 Bowman ..... B42F 7/08 206/215

(Continued)

FOREIGN PATENT DOCUMENTS

AU 2009243523 A1 6/2010
CN 201408391 2/2010

(Continued)

*Primary Examiner* — J. Gregory Pickett
*Assistant Examiner* — Jenine Pagan
(74) *Attorney, Agent, or Firm* — Boyle Fredrickson S.C.

(57) ABSTRACT

A case for accommodating tools or small parts includes a main body, having a lid, which is articulated in a pivotable manner on the main body, and a holder for documents and/or small parts, which is fastened on an inner side of the lid. The case is configured such that an inner side of the lid is provided with a plurality of first fastening devices, which are designed to match second fastening devices on the holder, wherein the first and second fastening devices are designed, and arranged, such that the holder can be secured in at least two different positions on the inner side of the lid.

12 Claims, 4 Drawing Sheets

(56) References Cited

U.S. PATENT DOCUMENTS 3,578,153 A * 5/1971 Olson ..... B25H 3/003 206/372
3,665,943 A * 5/1972 Lampman ..... A47L 15/502 134/200
4,611,713 A * 9/1986 Byrns ..... B25H 3/006 206/303
5,379,887 A 1/1995 Conley, Jr.
5,690,216 A * 11/1997 Liu ..... A45C 9/00 206/214
5,855,274 A 1/1999 Piao
6,083,579 A * 7/2000 Schurman ..... A45C 3/02 206/373
6,109,436 A 8/2000 He
6,279,744 B1 8/2001 Yu
6,415,922 B1 * 7/2002 Lee ..... B25H 3/003 206/372
7,090,074 B2 * 8/2006 Isaacs ..... A45C 11/18 206/214
7,364,041 B2 4/2008 Roesler
7,931,143 B1 * 4/2011 Lin ..... B25H 3/021 206/373
9,511,491 B2 * 12/2016 Brunner ..... B25H 3/02
2003/0159194 A1 8/2003 Frank
2004/0069668 A1 * 4/2004 Finnigan ..... B25H 3/003 206/372
2006/0065557 A1 * 3/2006 Brunson ..... B25H 3/003 206/273
2006/0070900 A1 4/2006 Brunson et al.
2007/0272572 A1 11/2007 Chen
2008/0135447 A1 * 6/2008 Wang ..... B25H 3/003 206/747
2014/0262885 A1 9/2014 Green et al.

FOREIGN PATENT DOCUMENTS

DE 1871599 U 5/1963
DE 29714049 10/1997
DE 29823041 U1 3/1999
WO 2003/082531 A1 10/2003

* cited by examiner

CASE FOR ACCOMMODATING TOOLS OR SMALL PARTS

FIELD OF THE INVENTION

The invention relates to a case for holding tools or small parts, having a main body, having a lid, which is articulated in a pivotable manner on the main body, and having a holder for documents and/or small parts, which is fastened on an inner side of the lid.

BACKGROUND

A case for holding tools or small parts is intended to be improved in terms of flexibility by means of the invention.

SUMMARY

The invention provides, for this purpose, a case for holding tools or small parts which has the features of Claim 1. Advantageous developments of the invention are indicated in the dependent claims.

A case according to the invention for holding tools or small parts has a main body, a lid, which is articulated in a pivotable manner on the main body, and a holder for documents and/or small parts, which is fastened on au inner side of the lid, wherein the inner side of the lid is provided with a plurality of first fastening devices, which are designed to match second fastening devices on the holder, wherein the first and second fastening devices are designed, and arranged, such that the holder can be secured in at least two different positions on the inner side of the lid.

The inner side of the lid can therefore optionally be provided with a holder, and the holder can be secured in at least two different positions on the inner side of the lid. This means that the interior of the case can be utilized in a more flexible manner. If, for example, the accommodation of an electric tool in a certain region, for example the handle region, requires a particularly large amount of space in the case, the holder may be arranged such that it does not come into contact with the handle of the electric tool when the lid is being closed. Depending on what should be, stored in the case, for example en electric tool or small parts, it is thus possible for the holder to be arranged in different positions or left out altogether. The holder can be used, for example, for operating instructions and data sheets, but also for small parts such as tools, USB sticks and the like.

In a development of the invention, the first and second fastening devices are designed in the form of latching devices.

This allows the holder to be fastened very straightforwardly, in particular without any tools being used, on the inner side of the lid. Depending on the intended use of the case, the holder is then latched straightforwardly in the desired position on the inner side of the lid.

In a development of the invention, the holder has in each case at least one through-opening in the region of the second fastening devices, wherein the at least one through-opening allows visual/optical inspection of the fully latched state of the latching devices.

The fact that the fully latched state of the latching devices can be inspected visually/optically means that a very straightforward and quick check can be carried out. Since it takes place visually/optically, such a check can also take place for example in an automated manner by means of cameras.

In a development of the invention, the first fastening devices have undercut openings and the second fastening devices have protrusions with undercuts.

This allows the holder to be latched very straightforwardly on the inner side of the lid by the undercuts of the protrusions being introduced into the undercuts of the openings.

In a development of the invention, the openings have an introduction portion and at least one elongate retaining portion, which extends from the introduction portion, wherein a width of the retaining portion is smaller than a width of the introduction portion.

The protrusions with the undercuts are thus introduced into the introduction portion of the openings and then pushed into the elongate retaining portion. The openings are dimensioned such that the protrusions can be pushed in; the width of the retaining portion is dimensioned such that the protrusion can engage behind the retaining portion.

A development of the invention provides two retaining portions, which extend from the introduction portion and enclose between them an angle of at least 90°.

This means that two different latching positions can be achieved using the opening, in that either a first retaining portion or a second retaining portion is used for introduction of the protrusions with the undercuts.

In a development of the invention, the second fastening devices have a stub, which extends from an underside of the holder, and a latching protrusion, which is arranged at the free end of the stub and projects laterally beyond the stub, an undercut therefore being formed between the latching protrusion and the underside of the holder.

Straightforward and reliable latching can be achieved by means of such a second fastening device.

In a development of the invention, the holder, in the region of the latching protrusion, has a through-opening, and therefore the latching protrusion, with the holder removed from the lid, can be seen through the through-opening and, with the holder installed correctly on the lid, is at least partially concealed by the inner side of the lid.

Such a design can readily allow the visual/optical inspection of correct latching.

In a development of the invention, the lid has at least one raised portion, which projects into the interior, wherein the lid has a covering part, which is arranged on the inner side of the lid and at least partially encloses the raised portion, wherein the covering part and the at least one raised portion form essentially a planar inner side of the lid.

Such a covering part allows a possibly non-planar inner side of the lid to be leveled out. This makes it possible for example for small parts to be arranged in the case such that the inner side of the lid, in the closed state of the lid, closes the compartments for the small parts, and therefore the small parts cannot shift about in the case. Furthermore, an essentially planar inner side of the lid makes it easier for the holder to be arranged in a plurality of different positions.

In a development of the invention, the first fastening devices are provided on the covering part.

Since the covering part partially encloses the raised portion on the inner side of the lid and at the same time, together with the raised portion, forms an essentially planar inner side of the lid, the covering part may be spaced apart from the wall of the lid in certain regions. This provides sufficient space, on the covering part, for forming a latching device with undercuts, for example a through-opening with an introduction portion and a retaining portion.

In a development of the invention, the holder is defined in the form of a plastics injection moulding. A plastics-injection-moulding design allows large numbers to be produced cost-effectively. The second fastening devices may be produced in one piece with the holder, for example in the form of stubs and latching protrusions arranged at the free end of the stubs.

In a development of the invention, the holder has a resilient tongue, which butts against the inner side of the lid.

By means of such a resilient tongue, documents can be reliably retained within the holder, and therefore they do not fall out when the case is being transported and opened.

In a development of the invention, the first fastening devices are arranged on the lid, and the second fastening devices are arranged on the holder, at the same unit spacings apart.

Arranging the first and second fastening devices at the same unit spacings apart makes it very straightforward for the holder to be able to be fastened in a plurality of different positions on the inner side of the lid.

In a development of the invention, the distances between the first fastening devices on the lid and the distances between the second fastening devices on the holder are arranged at the same unit spacings apart both in the longitudinal direction and in the transverse direction of the lid.

This means that it is not just possible for the holder to be displaced in one direction relative to the lid, and then fastened on the lid again; rather, it is also possible for the holder to be fastened in two different positions, rotated through 90° in relation to one another, on the inner side of the lid.

In a development of the invention, the second fastening devices on the holder are arranged at the corner points of an imaginary square, wherein a side length of the square corresponds to a distance between the first fastening devices on the lid or a multiple of said distance.

This makes it easier for the holder to be arranged in different positions rotated through 90° in relation to one another.

Further features and advantages of the invention can be gathered from the claims and from the following description of preferred embodiments of the invention in conjunction with the drawings, in which:

DETAILED DESCRIPTION

Figure 1:
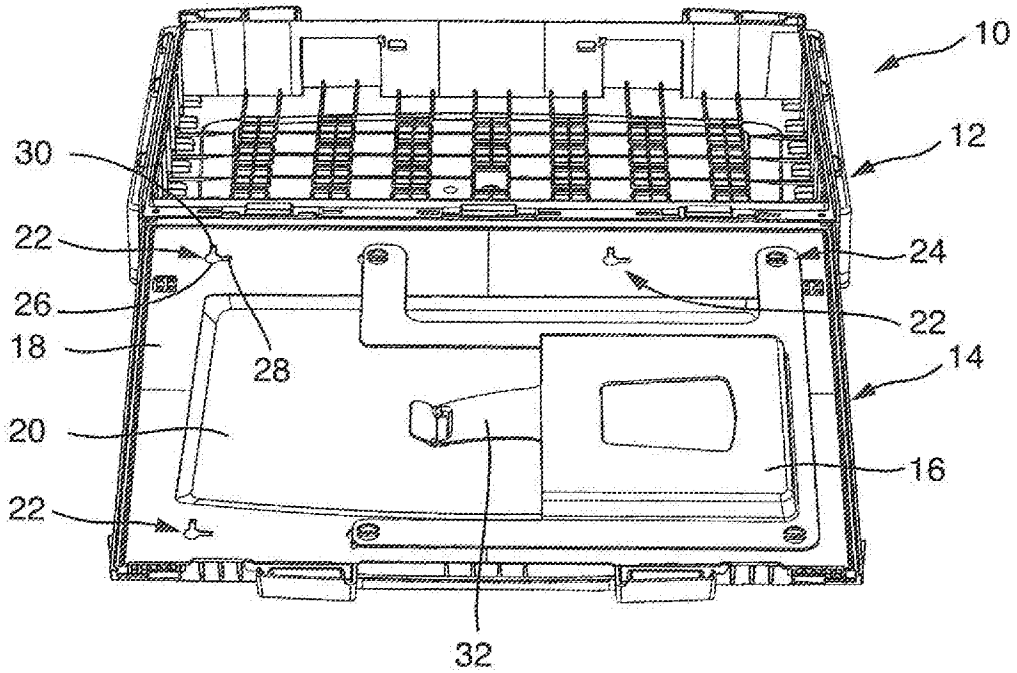
FIG. 1 shows an illustration of a case according the invention in the fully opened state.

The illustration of FIG. 1 shows a case 10 according to the invention having a main body and a lid 14, which is articulated in a pivotable manner on the main body 12. A holder 16, into which documents, for example operating instructions or data sheets, can be pushed is provided on the inner side of the lid 14. The holder 16 is designed in the form of an injection moulding and is fastened on a covering part 18 on the inner side of the lid 14. The covering part is in the form of a passepartout and encloses a raised portion 20 on the inner side of the lid 14. The raised portion 20 extends inwards when the lid of the case 10 is fully closed, see, for example, FIG. 8. In the illustration of FIG. 1, the raised portion 20 thus extends upwards, in the direction of the viewer. An essentially planar inner side of the lid 14 is created as a result of the covering part 18 enclosing the raised portion 20.

The covering part 18 is provided with a total of eight first fastening devices 22, wherein only three of the first fastening devices 22 can be seen in their entirety in the illustration of FIG. 1; the rest of the first fastening devices are at least partially concealed. The first fastening devices 22 are provided in each case in the form of through-openings, in which second fastening devices 24 on the holder 16 can latch. The holder 24 is provided with a total of four second fastening devices, although these can only partially be seen in the illustration of FIG. 1. The second fastening devices 24 of the holder 16 are introduced into the openings of the first fastening devices 22, to be precise into an essentially circular introduction portion 26. Proceeding from the introduction portion 26, the second fastening devices 24 are then displaced linearly in the direction of a slot-like retaining portion 28 or 30. Since the retaining portions 28, 30 are each designed in the form of an elongate slot, and are narrower than the introduction portion 26, the second fastening devices 24 on the holder can engage behind the covering part 18 in the region of the retaining portions 28 or 30, and the holder 16 can thus latch securely on the covering part 18 and therefore on the inner side of the lid 14.

It can be seen in FIG. 1 that, for latching on the covering part 18, the holder 16, starting from the introduction portion 26, can be displaced in the direction of the first retaining portion 28, that is to say to the right of FIG. 1. As an alternative to this, it is also possible for the holder 16 to be displaced in the direction of the second retaining portion 30, that is to say upwards in the illustration of FIG. 1. Even this means different positions of the holder 16 on the covering part are possible.

It is also possible, as can be seen with reference to FIG. 1, for the covering part 16 to be fastened on the inner side of the lid 14 not just in the position illustrated in FIG. 1, but also in a position displaced to the left in relation to the position illustrated. All that would be required for this purpose would be for the second fastening portions 24 to be inserted into the first fastening devices 22 illustrated on the far left of the covering part 18 in FIG. 1. The holder 16 is always arranged by way of all four second fastening devices 24 on the first fastening devices 22, which are arranged on the covering part 18 in a manner matching the second fastening devices 24, and at the same unit spacings apart.

The holder 16 is designed in the form of an injection moulding and has a resilient tongue 32, which butts against an inner side of the lid 14 when the holder 16 is latched on said inner side. In the case of the embodiment illustrated, and when, as in FIG. 1, the holder 16 is empty, the resilient tongue butts against the inner side of the raised portion 20 of the lid 14. Any documents pushed into the holder 16 are retained reliably in place by the resilient tongue.

Figure 2:
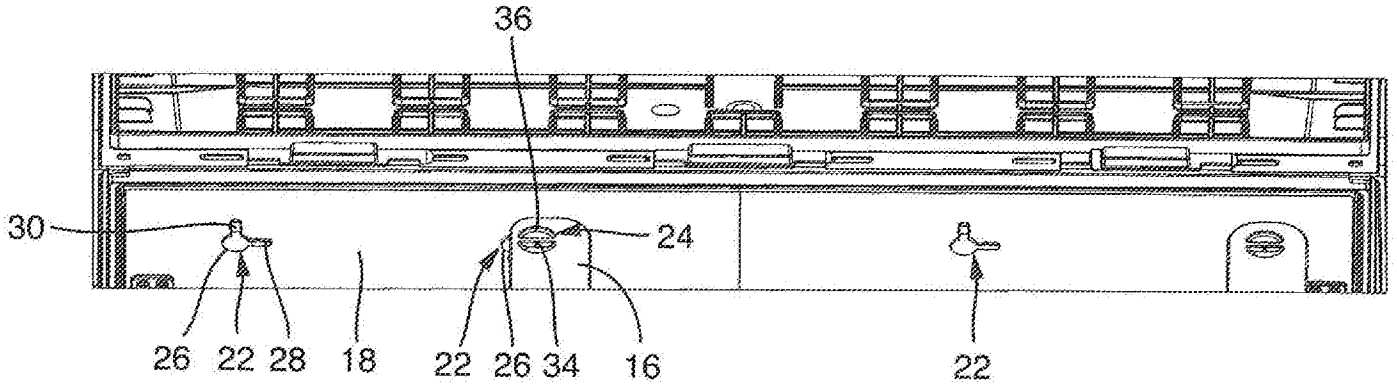
FIG. 2 shows an enlarged illustration of part of the case from FIG. 1.

The illustration of FIG. 2 shows part of the illustration of FIG. 1 on an enlarged scale. It shows the configuration of the first fastening devices 22 on the covering part 18, each with a circular introduction portion 26 and two elongate retaining portions 28, 30, which extend from the introduction portion 26, wherein the first retaining portion 26 and the second retaining Portion 30 enclose an angle of 90° in relation to one another. A further part of the introduction opening 26 can be seen on the first fastening device 22 which is illustrated as being second from the left in FIG. 2. The rest of the introduction opening 26 and the two retaining portions 28, 30 are concealed by the holder 16. It is also the case that only part of the second fastening device 24 of the holder 16 is evident. The second fastening devices 24 have two through-openings 34, 36, which are separated from another by a crosspiece and, together, are more or less circular in shape. Extending from the crosspiece is a stub, which extends into the first retaining portion 28. A radially projecting protrusion is then arranged at the free end of the stub, said protrusion engaging behind the first retaining portion 28 and thus latching the second fastening device 24 on the first fastening device 22. The two through-openings 34, 36 allow visual/optical inspection of the fully latched state. This is because, when it is still possible to see the circular introduction opening 26 through the through-openings 34, 36, the fully latched state has not yet been achieved. It is only when the two through-openings 34, 36 are concealed by those portions of the covering part 18 which are adjacent to the first retaining portion 28 that the fully latched state has been achieved. This allows a very straightforward check as to whether the holder 16 is latched correctly on the covering part 18. Such a check can also take place for example in an automated manner by means of cameras.

Figure 3:
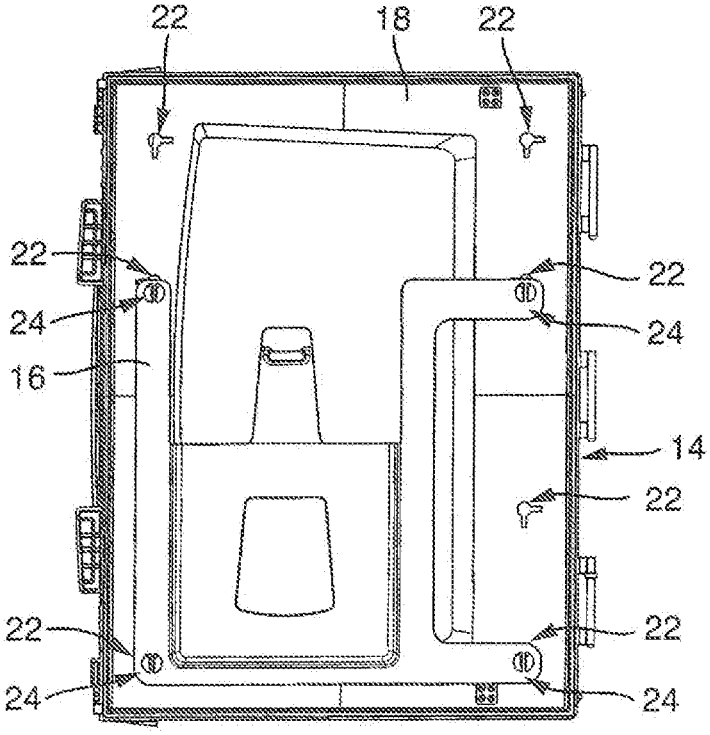
FIG. 3 shows a plan view of the lid of the case from FIG. 1.

The illustration of FIG. 3 shows a plan view of the lid 14 from FIG. 1. It can be seen in the illustration of FIG. 3 that the first fastening devices 22 are arranged on the inner side of the lid 14, or on the covering part 18, at the same unit spacings apart as the second fastening devices 24 on the holder 16. Especially, the distance in the transverse direction of the lid 14, that is to say from bottom to top in FIG. 3, between the two fastening devices 24 on the holder 16 is precisely double the distance between two first fastening devices 22 on the inner side of the lid 14, also seen in the transverse direction, that is to say from bottom to top in FIG. 3. This makes it possible for the holder 16 to be fastened on the lid 14 not just in the position illustrated in FIG. 3, but also in a manner offset in the transverse direction, that is to say offset upwards in FIG. 3, by the distance between two first fastening devices 22 in relation to the position illustrated.

Figure 4:
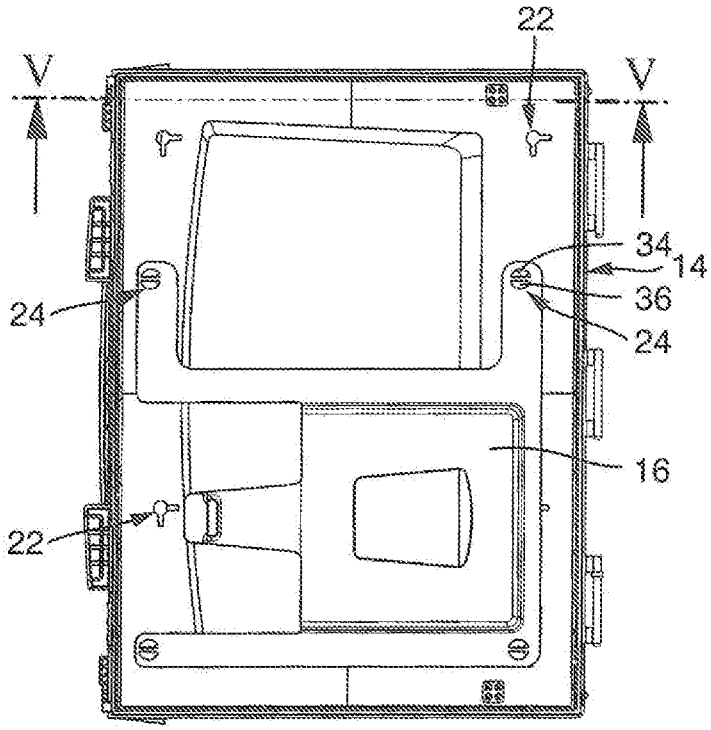
FIG. 4 shows a plan view of the lid from FIG. 3, the holder being arranged in a different position.

FIG. 4 shows the lid 14 from FIG. 3 likewise in a plan view, wherein the holder 16 has been rotated anticlockwise through 90° in relation to the position from FIG. 3. This is possible since the distance between the first fastening devices 22 in the longitudinal direction of the lid 14, that is to say from right to left in FIGS. 3 and 4, corresponds to the distance between the second fastening devices 24. The second fastening devices 24 on the holder 16 are thus arranged at the four corners of an imaginary square. Proceeding from the position illustrated in FIG. 4, it is clearly still possible for the holder 16 to be offset upwards on the lid 14 by the distance between two first fastening devices 22. In addition, the holder 16 in FIG. 4 may be arranged on the inner side of the lid 14 in a state in which it has been rotated through 90° or 180°.

As has been explained, a total of eight first fastening devices 22 are provided on the inner side of the lid 14, wherein the first fastening devices 22 are arranged at the same unit spacings apart as the second fastening devices 24 on the holder. The second fastening devices 24 on the holder, furthermore, are arranged at the corner points of an imaginary square, wherein the side length of the square corresponds to double the distance between two first fastening devices 22 on the inner side of the lid 14. It is thus possible for the holder 16 to be arranged in a total of six different positions on the inner side of the lid 14. These are especially the two positions illustrated in FIGS. 3 and 4 and, addition, a position rotated clockwise through 90° in relation to FIG. 3. Also possible are three further positions, if use is made of the first fastening devices 22 illustrated at the top of FIG. 3. Using these two upper first fastening devices 2 and then the first fastening devices illustrated as second from bottom in FIGS. 3 and 4, once again, allows three positions of the holder 16, each rotated through 90° in relation to one another.

The plan views of FIGS. 3 and 4 show to good effect that the fully latched state of the first and second fastening devices 22, 24 can be visually/optically inspected from above. This is because, in the fully latched state illustrated, the two through-openings 34, 36 are more or less fully closed and the introduction portion 26 is in turn concealed by the holder 16.

As has already been explained, in addition to the six different positions described, it is also possible to provide for six further positions of the holder 16 on the inner side of the lid 14 by use being made, instead of the first retaining portion 28, of the second retaining portion 30 for latching the respective second fastening devices 24.

There is therefore a very high level of flexibility as far as arranging the holder 16 on the inner side of the lid 14 is concerned, and the holder 16 can be arranged in each case such that there is sufficient space available for accommodating a wide variety of different tools in the case 10.

Figure 6:
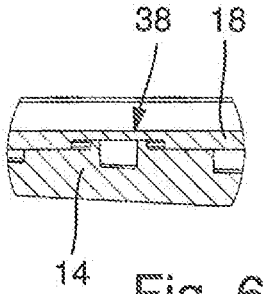
FIG. 6 shows an enlarged illustration of the detail VI in FIG. 5.
Figure 5:
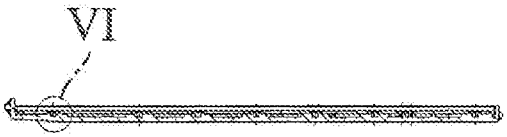
FIG. 5 shows a view of the section plane V-V from FIG. 4.

The illustration of FIG. 5 shows a view of section plane V-V in FIG. 4, and the illustration of FIG. 6 shows the enlarged detail VI from FIG. 5. It can be seen that the covering part 18 is connected to the inner side of the lid 14 only in part. Specifically, the covering part 18 is connected to the lid 14 in the region of protrusions 38 on the inner side of said lid. In the region of these protrusions 38, the covering part 18 is welded ultrasonically to the lid 14. Both the lid 14 and the covering part 18 consist of plastic which can be welded by means of ultrasound. The protrusions 38 may be, for example, in the form of a ring in each case or in the form of domes. As is illustrated, the shape of the protrusions 36 and the shape of the covering part 18 is selected such that it is possible to compensate for tolerances in the production of the lid 14 and of the covering part 18.

Figure 7:
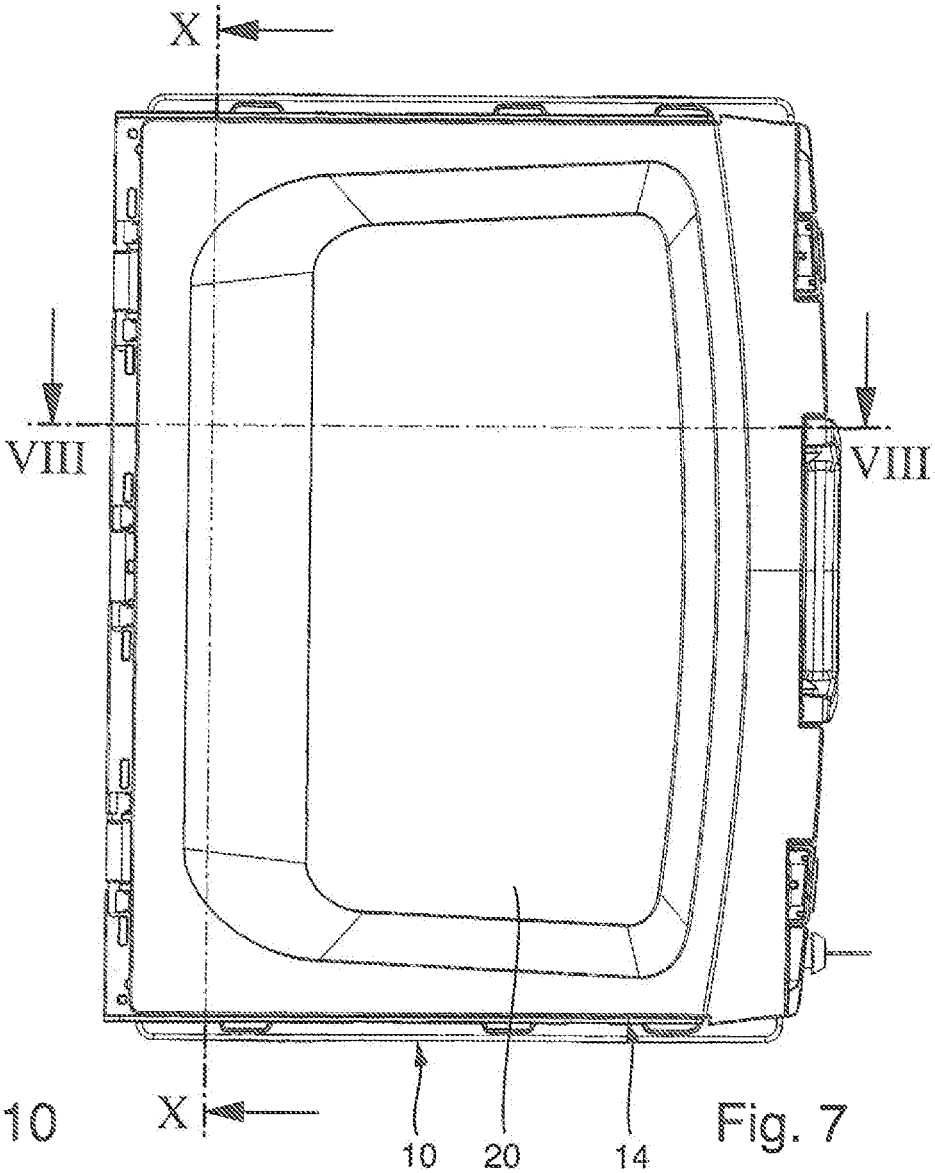
FIG. 7 shows a plan view of the case from FIG. 1 with the lid fully closed.

The illustration of FIG. 7 shows a plan view of the case 10 with the lid 14 fully closed. The illustrations shows to good effect the raised portion in the lid 14, said raised portion extending downwards, that is to say into the image plane, in the illustration of FIG. 7.

Figure 8:
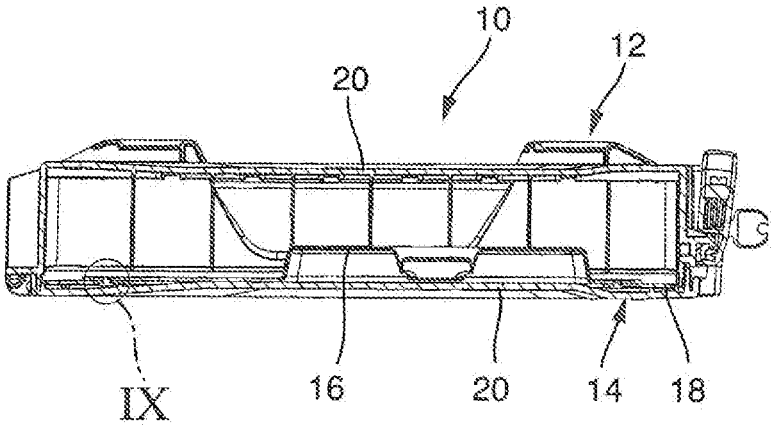
FIG. 8 shows a view of the section plane VIII-VIII in FIG. 7.
Figure 10:
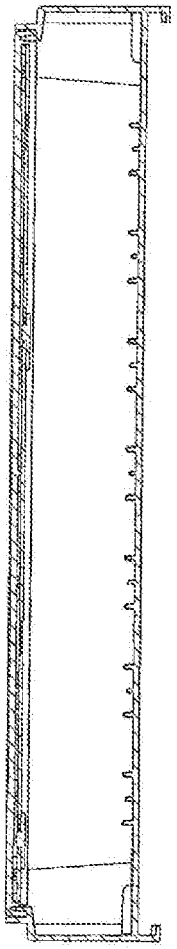
FIG. 10 shows a view of the section plane X-X in FIG. 7.

FIG. 8 shows a view of section plane VIII-VIII in FIG. 7. It can be seen that it is not just the lid 14, which is located at the bottom of FIG. 8, which has a raised portion 20 projecting into the interior of the case 10; rather, it is also the case that the underside of the main body 12, said underside being located at the top of FIG. 8, has a corresponding raised portion 20.

It can be seen in the illustration of FIG. 8 that the covering part 18 is on the inner side of the lid 14, and it can also be seen that the covering part and the inner surface of the raised portion 20 provide for an essentially planar inner side of the lid 14. The holder 16, fastened on the inner side of the lid 14, can likewise be seen in FIG. 8.

Figure 9:
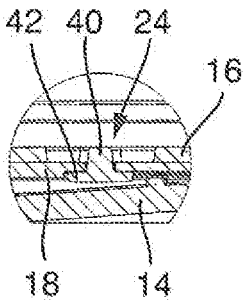
FIG. 9 shows an enlarged illustration of the detail IX in FIG. 8.

The illustration of FIG. 9 shows the enlarged detail IX from FIG. 8. The illustration shows a portion of the lid 14 and also the covering part 18. Positioned on the inner side of the lid. Also evident are a portion of the holder 16 and especially the design of one of the second fastening devices 22 on the holder 16. As has already been explained, the second fastening devices 24 each have a stub 40, which extends away from the holder and at the free end of which is arranged a protrusion 42 which extends radially away from the stub 40. In the case of the embodiment illustrated, the protrusion is in the form of a circular disc. An external diameter of the protrusion 42 is slightly smaller than an internal diameter of the introduction portion 26 of the first fastening devices 22 on the covering part 18, see FIG. 1. In the position illustrated in FIG. 9, the holder 16 has already been displaced relative to the covering part 18 such that the stub has been pushed into the first retaining portion 28 or the second retaining portion 30 and the protrusion 42 thus engages behind the covering part 18, that it butts against the underside of the regions adjacent to the first retaining portion 28 or the second retaining portion 30.

Figure 11:
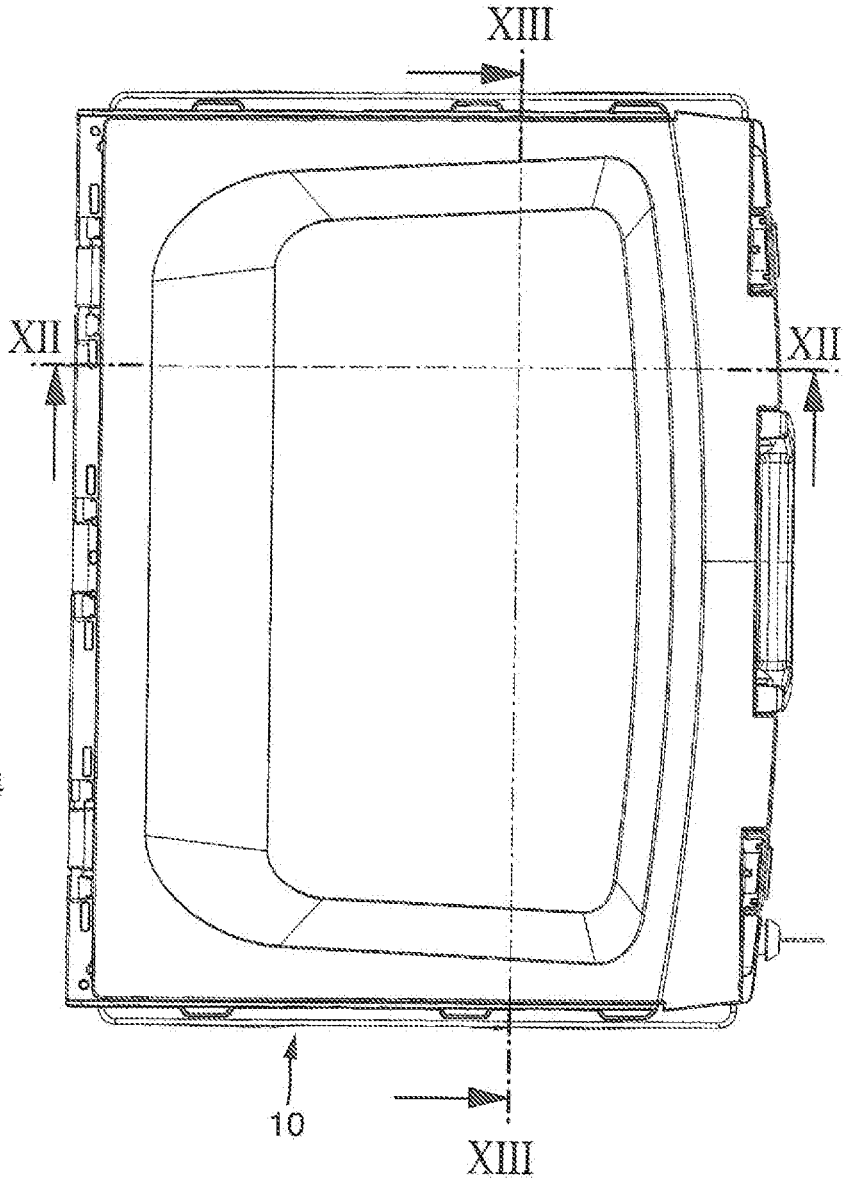
FIG. 11 shows a plan view, corresponding to FIG. 7, of the case with the lid fully closed.

The illustration of FIG. 11 shows a view of the case 10 from above corresponding to FIG. 7. However, section planes XII-XII and XIII-XIII are positioned differently in FIG. 11 to the section planes VIII-VIII and X-X in FIG. 7.

Figure 12:
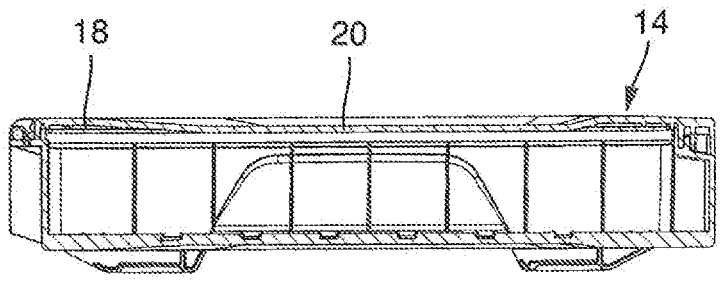
FIG. 12 shows view of the section plane XII-XII in FIG. 11.

FIG. 12 shows a view of section plane XII-XII in FIG. 11. The figure clearly shows the raised portion 20 in the lid 14, the latter being arranged at the top in the illustration of FIG. 12. Also evident is the covering part 18, which encloses the raised portion 20 in the form of a passepartout and, together with the inner side of the raised portion 20, provides for an essentially planar inner side of the lid 14.

Figure 13:
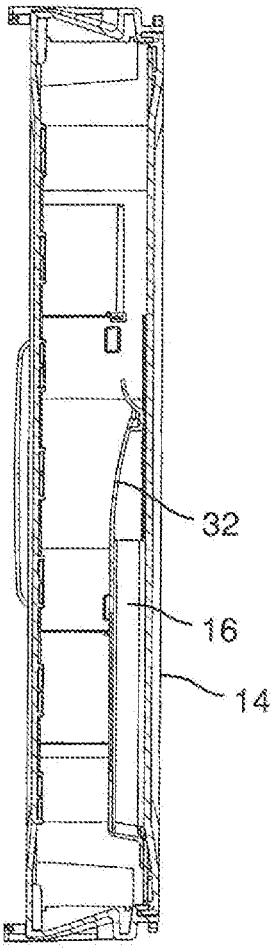
FIG. 13 shows a view of the section plane XIII-XIII in FIG. 11.

The illustration of FIG. 13 shows a view of section plane XIII-XIII from FIG. 11. The illustration clearly shows the holder 16 and especially the resilient tongue 32 of the holder 16, which butts against the inner side of the lid 14 when no documents have been pushed into the holder 16.

The invention claimed is:

1. A case for accommodating tools or small parts, comprising:

a main body, having a lid, which is articulated in a pivotable manner on the main body, and having a holder for documents and/or small parts, which is fastened on an inner side of the lid, wherein the inner side of the lid is sized to receive the holder and is provided with a plurality of first fastening devices, which are designed to match second fastening devices on the holder, wherein the first and second fastening devices are designed, and arranged, such that the holder can be secured in at least two different positions, displaced from each other, on the inner side of the lid, wherein the first and second fastening devices are designed in the form of latching devices, wherein the first fastening devices have undercut openings and the second fastening devices have protrusions with undercuts, and wherein the openings have an introduction portion and at least one elongate retaining portion, which extends from the introduction portion, wherein a width of the retaining portion is smaller than a width of the introduction portion.

2. The case according to claim 1, wherein the holder has at least one through-opening in the region of the second fastening devices, wherein the at least one through-opening allows a visual/optical inspection of the fully latched state of the fastening devices.

3. The case according to claim 1, further including two retaining portions, which extend from the introduction portion and enclose between them an angle of at least 90 degrees.

4. The case according to claim 1, wherein the second fastening devices have a stub, which extends from an underside of the holder, and a latching protrusion, which is arranged at the free end of the stub and projects laterally beyond the stub, an undercut therefore being formed between the latching protrusion and the underside of the holder.

5. The case according to claim 4, wherein the holder, in the region of the latching protrusion, has at least one through-opening, and therefore the latching protrusion, with the holder removed from the lid, can be seen through the through-opening and, with the holder installed correctly on the lid, is at least partially concealed by the inner side of the lid.

6. The case according to claim 1, wherein the lid has at least one raised portion, which projects into the interior, wherein the lid has a covering part, which is arranged on the inner side of the lid and at least partially encloses the raised portion, wherein the covering part and the at least one raised portion form an essentially planar inner side of the lid.

7. The case according to claim 6, wherein the first fastening devices are provided on the covering part.

8. The case according to claim 1, wherein the holder is designed in the form of a plastics injection moulding.

9. The case according to claim 1, wherein the holder has a resilient tongue, which butts against the inner side of the lid when the holder is empty.

10. The case according to claim 1, wherein the first fastening devices are arranged on the lid, and the second fastening devices are arranged on the holder, at the same unit spacings apart.

11. The case according to claim 10, wherein the distances between the first fastening devices on the lid and the distances between the second fastening devices on the holder are arranged at the same unit spacings apart both in the longitudinal direction and in the transverse direction of the lid.

12. The case according to claim 11, wherein the second fastening devices on the holder are arranged at the corner points of an imaginary square, wherein a side length of the square corresponds to a distance between the first fastening devices on the lid or a multiple of said distance.

* * * * *